US006453840B1

(12) United States Patent
Higginbotham et al.

(10) Patent No.: US 6,453,840 B1
(45) Date of Patent: Sep. 24, 2002

(54) DAMAGE TOLERANT INFLATABLE

(75) Inventors: Paul Higginbotham, Richmond (CA); Ping Yin Sheu, Delta (CA)

(73) Assignee: Mustang Survival Corp., Richmond (CA)

( * ) Notice: Subject to any disclaimer, the term of this patent is extended or adjusted under 35 U.S.C. 154(b) by 0 days.

(21) Appl. No.: 09/923,381

(22) Filed: Aug. 8, 2001

(51) Int. Cl.[7] ..... B63B 7/00

(52) U.S. Cl. ..... 114/345; 5/710; 52/2.11; 52/2.23; 441/40; 441/66

(58) Field of Search ..... 114/61.25, 345, 114/360; 441/40, 41, 66, 129; 5/710; 297/DIG. 3; 52/2.11, 2.23

(56) References Cited

U.S. PATENT DOCUMENTS 1,509,551 A * 9/1924 Gibson
1,620,421 A * 3/1927 Wilson
3,298,044 A * 1/1967 Saltness et al.
4,348,779 A * 9/1982 Leber
5,304,082 A * 4/1994 Wolfe

FOREIGN PATENT DOCUMENTS

GB 2 174 958 A * 11/1986 ..... 114/345

* cited by examiner

*Primary Examiner*—Sherman Basinger
(74) *Attorney, Agent, or Firm*—C. A. Rowley

(57) ABSTRACT

An inflatable device having a safety system provided by having at least two separate and distinct independently inflatable bladders contained within the outer shell of the device. Each of the bladders is designed when fully inflated to fully inflate the shell, but during use one of the bladders is not fully inflated and has a projected area of no greater than 50% of the projected area of the inflated shell.

20 Claims, 5 Drawing Sheets

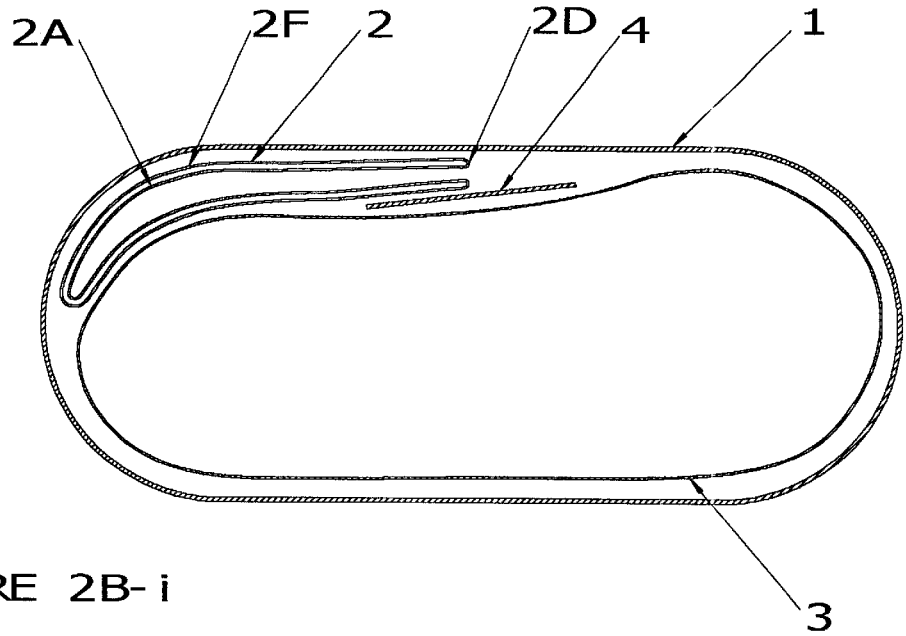
FIGURE 2B-i
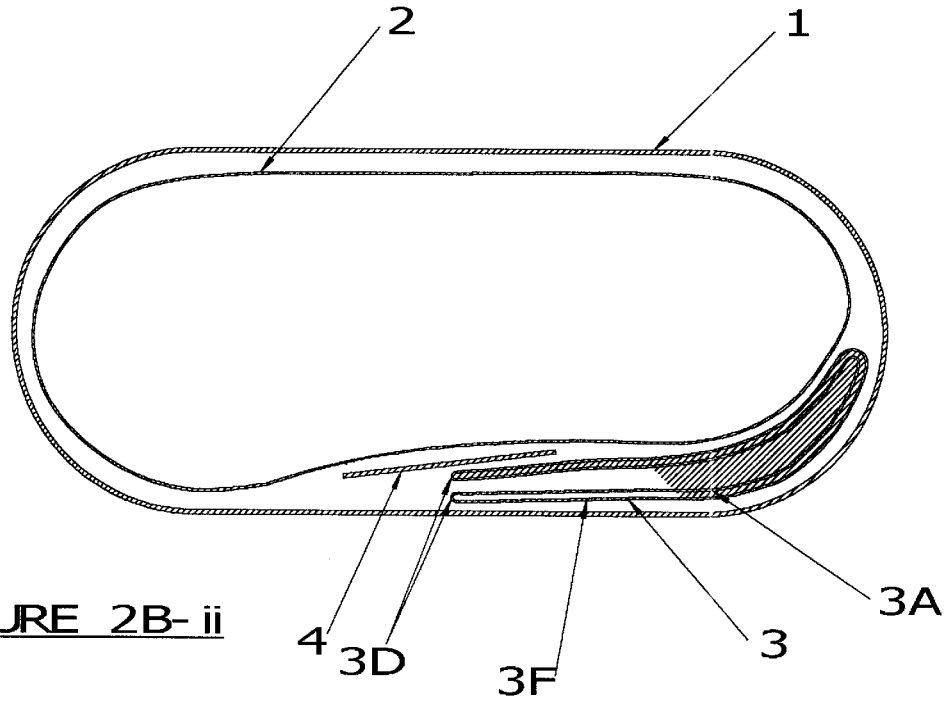
FIGURE 2B-ii

FIGURE 2B- iii

DAMAGE TOLERANT INFLATABLE

FIELD OF THE INVENTION

The present invention relates to an inflatable device incorporating a plurality of bladders to provide added safety in the event of a puncture.

BACKGROUND OF THE PRESENT INVENTION

Inflatables are used for a vast range of purposes including inflatable boats, personal floatation devices (PFD) and various recreational, commercial or military products. In particular, the function of most inflatable devices is entirely dependent on the ability of the device to hold air. In many applications it is desirable for a device to inflate even in the presence of some type of physical damage to the device.

It is well known to provide these inflatable devices with separate compartments or bladders that are separately inflatable and who's combined inflation volume is required to complete the filling of the confined space formed by the outer skin. In many applications the skin also forms a wall of the compartments or bladder(s). e.g. inflatable rafts, some air mattresses etc. Applicant is aware of an inflatable pool toy (kayak, it is believe) where inside the outer shape forming skin were at least 3 bladders (the skin formed the wall or some of the walls of each bladder). The main bladder (may have been a pair of side by side main bladders, Applicant is not sure) was inflated to form the shape of the toy. Inside the toy were a pair of separate independent auxiliary small bladders that had minimum exposure to the skin of the toy (probably less than about 30%) and their inflation did not significantly change the shape of the toy. The concept was that if the main bladder(s) were puncture these independent bladders were sufficient to support the person but obviously lower in the water, i.e. with the main bladder(s) inflated the toy floated with about 70% above water when a child was on it, with only the independent bladders the toy would likely still support the child but would sink to just below the surface of the water so that it applied maximum buoyancy. The auxiliary small bladders were filled through their own separate fillers before use (and when inflated these bladders simply occupied space in the toy). It is possible not to inflate these auxiliary bladders but if the main bladder were punctured the device would tend to sink until the small auxiliary bladders were filled and for this toy would not provide for the safety of the child who may not have the capability to inflate these small bladders.

BRIEF DESCRIPTION OF THE PRESENT INVENTION

It is the main objective of the present invention to provide an inflatable system whereby in the event of damage to the device the inflatable may retain the ability to hold air and function as intended.

Broadly the present invention relates to an inflatable device comprising a shape defining shell containing at least two separate inflatable bladders, each said bladder having and inflation means capable of inflating its respective bladder, each said bladder being of a size when fully inflated to fully inflate said shell, at least one of said being an initially deflated bladder which in deflated condition is folded upon itself to provide a folded end on said deflated bladder, said folded end positioned facing the other of said at least two bladders and said deflated bladder being positioned within said shell so that it occupies no more than 50% of the total cross sectional area of the major surface of said shell when said shell is fully inflated by one of said bladders.

Preferably said another of said deflated bladder is positioned so that said deflated bladder occupies less than 30% of said cross sectional area.

Preferably a divider panel is interposed between the bladders.

Preferably said folded on itself comprise a portion of said deflated bladder being tucked inside other portion of said deflated bladder.

Preferably each of said at least two bladders are deflated bladders and each is folded upon itself to provide a folded end on each said deflated bladder, said folded ends on each of said deflated bladders positioned adjacent to each other, said divider panel being symmetrically positioned with respect to said adjacent folded ends of said bladders and overlapping each of said bladders in the directions parallel to said folded ends and perpendicular to said folded ends so that during inflation of one of said bladder, said one of said bladders being inflated may slide past the adjacent fold edge an adjacent of said bladders.

Preferably said inflating means comprises a sealable manual inflating tube.

BRIEF DESCRIPTION OF THE DRAWINGS

Further features, objects and advantages will be evident from the following detailed description of the present invention taken in conjunction with the accompanying drawings in which

FIG. 1C is a schematic sectional illustration of one embodiment of the invention of the deflated device along the line 1C—1C of FIG. 1A illustrating a restraint layer or the divider interposed there between.

FIG. 2B*i* is a schematic sectional illustration device along the line 2B—2B of FIG. 2A illustrating one embodiment of the present invention.

FIG. 2B*ii* is a schematic illustration along the line 2B—2B of FIG. 2A illustrating an alternative arrangement of the embodiment of the present invention of FIG. 2B*i*.

FIG. 2B*iii* is a schematic illustration along the line 2B—2B of FIG. 2A illustrating a second embodiment of the present invention wherein both bladders are partially inflated.

DESCRIPTION OF THE PREFERRED EMBODIMENTS

As illustrated the present invention relates to a floatation or other inflatable device 10 that has its outer periphery (shape) determined or defined by a confining shell 1 which may be made of any suitable material for example a water proof material or fabric.

Figure 1A:
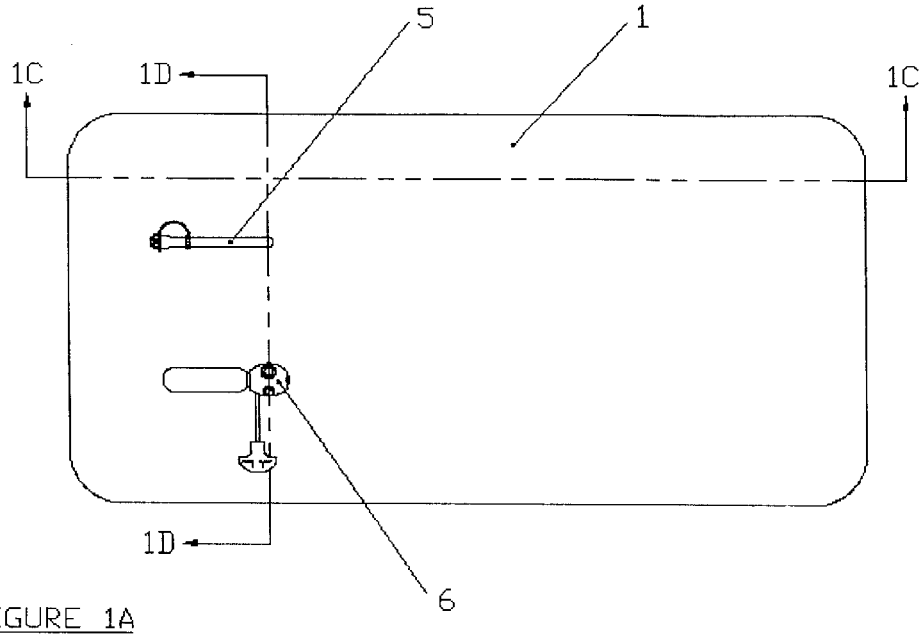
FIG. 1A is a schematic illustration of a device constructed in accordance with the present invention, as viewed from one side, while in the deflated state.
Figure 1B:
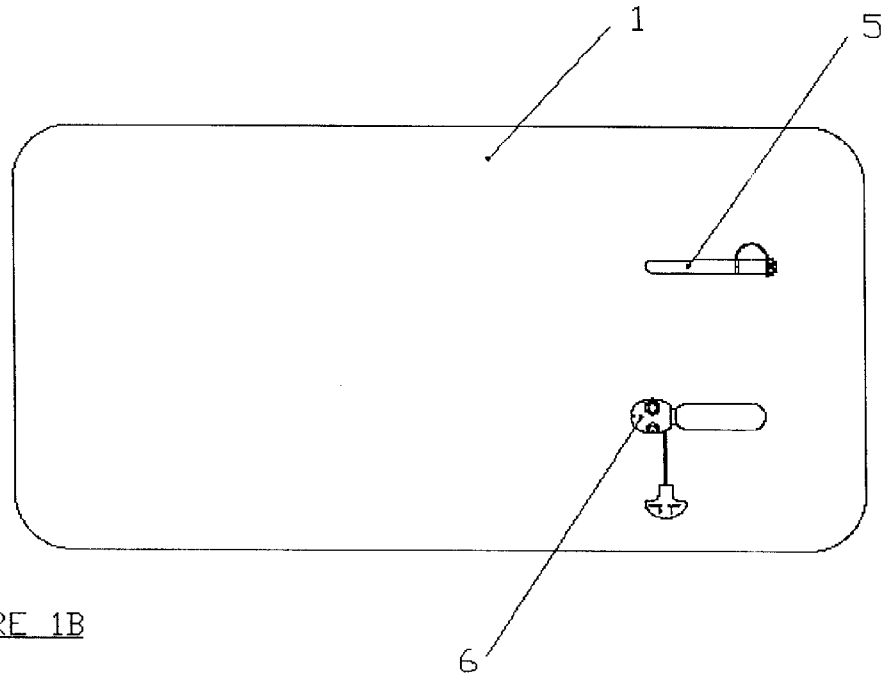
FIG. 1B is a schematic illustration of a device constructed in accordance with the present invention, as viewed from the opposite side to that of FIG. 1A, while in the deflated state.
Figure 1C:
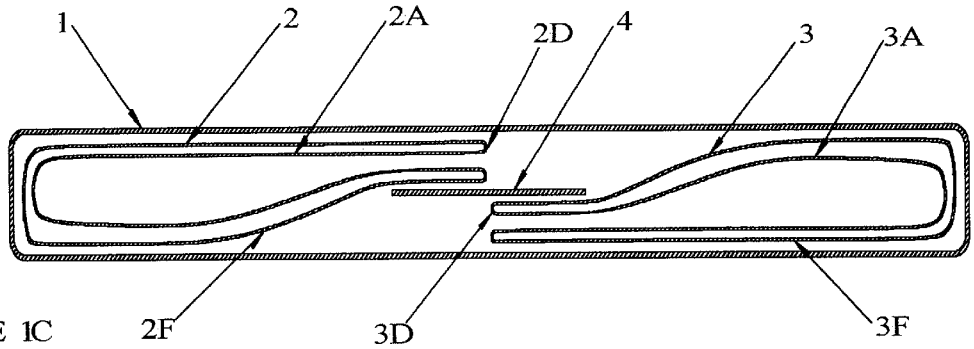
Figure 1D:
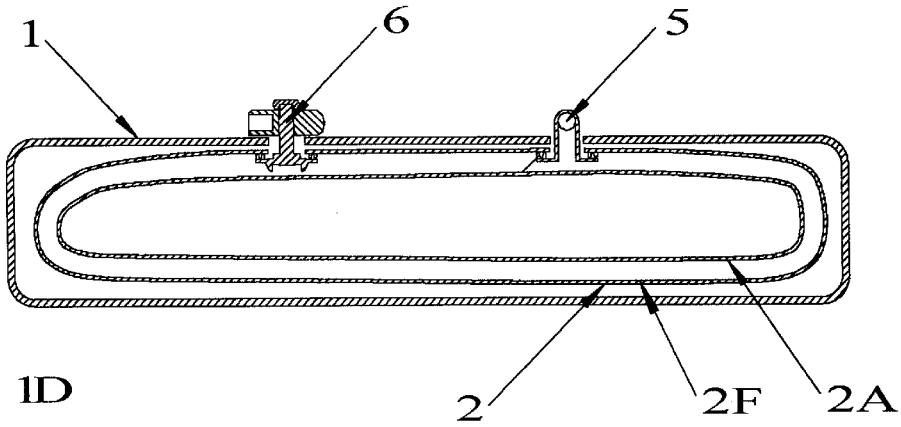
FIG. 1D is a schematic sectional illustration of the deflated device along the line 1D—1D of FIG. 1A illustrating the inflation components and the bladder folded into itself.
Figure 2A:
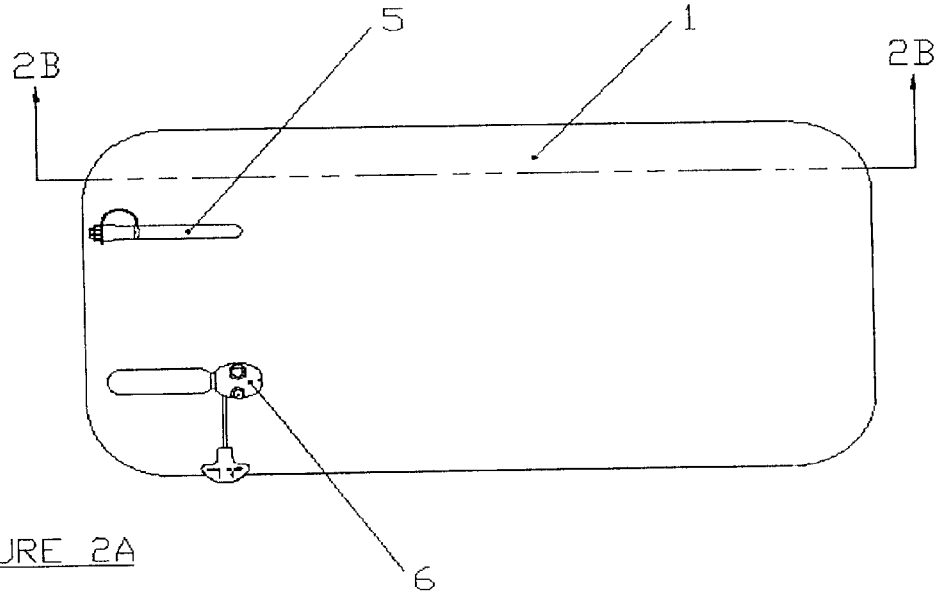
FIG. 2A is a schematic illustration of a device constructed in accordance with the present invention, as viewed from one side, while in the inflated state.

Contained within the shell 1 are at least 2 separate and independent bladders 2 and 3 each of which in the inflated condition fully fills the shell 1 and determines the shape of the shell 1 and in non inflated condition is preferably folded within itself as illustrate in FIG. 1C. The portions 2A and 3A respectively of each of the bladders 2 and 3 are folded within the other (outer) portion 2F and 3F respectively of each bladder 2 and 3 and define folded ends 2D and 3D of the bladders 2 and 3. It is important that the projected area of the deflated bag not exceed 50% of the project area of the inflated shell 1 e.g. when viewed in from the same side as FIG. 1A or 1B or FIG. 2A. Preferably the deflated bladder will have an even smaller area (see FIG. 3) e.g. less than 30% of the projected area of the inflated shell 1.

It is preferred to include a divider 4 between the bladders 2 and 3 and to position the divider between the adjacent edges or ends of the bladders 2 and 3 when the bladder are in deflated condition. Positioning the divider panel 4 in this manner helps to prevent interference between these adjacent ends when one bladder is being inflated before the other, as is normally the case.

The divider 4 preferably is symmetrically positioned relative to a central position relative to the adjacent edges of the bladders 2 and 3 and the divider should be sized and positioned so that the divider 4 overlaps each of the bladders 2 and 3 by a distances parallel to and perpendicular to the adjacent edges of the bladders 2 and 3 sufficient to direct one bladder to ones side of the other bladder when the one bladder is being inflated. For most applications this will require that the length of divider 4 measured in the direction parallel to the adjacent edges of the bladders be at least about ½ the length of one of the adjacent edges and the width of and overlap of the divider with each of the bladders 2 and 3 be generally be at least about 6 inches (30 cm) for folded bladders unless the system is used with a very small shell 1 and correspondingly small bladders 2 and 3.

Each of the bladders 2 and 3 is provided with its own inflation device, preferably each is provided with two different inflation devices as indicated at 5 and 6. The device 5 on each of the bladders 2 and 3 is a closeable or sealable inflation tube to permit each bladder to be blown up by mouth. The inflating devices indicated at 6 may be manually or automatically actuated inflation devices that activate or open a cylinder of gas to inflate its respective of the bladders 2 and 3.

FIG. 2B*i* shows the preferred manner of using the present invention wherein one of the bladders 2 and 3 in this illustration bladder 3 is fully inflated to define the shape of the shell 1 while the bladder 2 remains deflated. FIG. 2B*ii* shows the same effect as illustrated in FIG. 2B*i* but wherein the bladder 2 has been inflated to define the shape of the shell 1 and the bladder 3 remains deflated.

Figure 3:
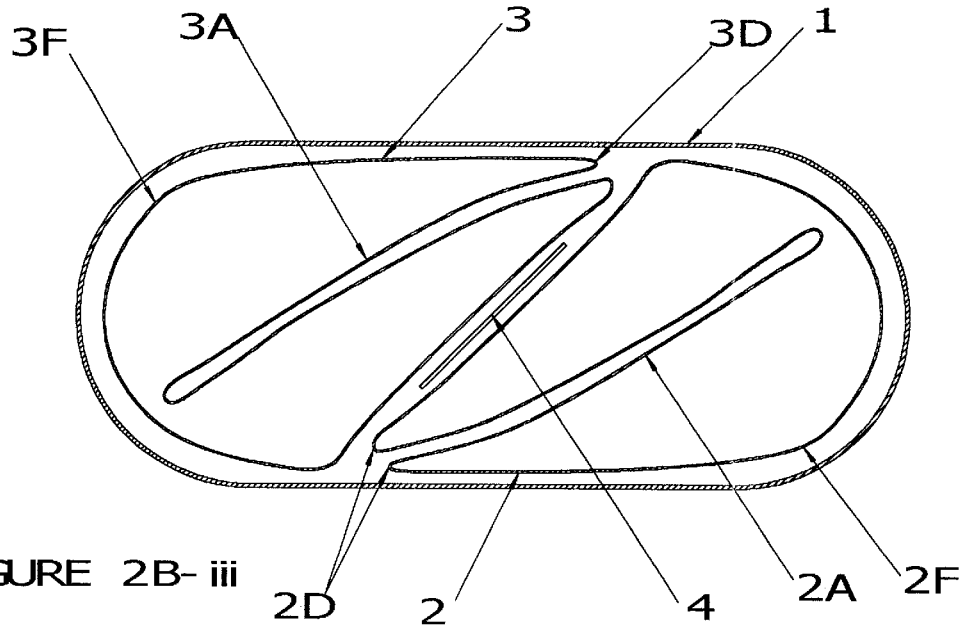
FIG. 3 is a section through one of the bladders showing the bladder in deflated condition and turned or folded into itself more than once.
Figure 3:
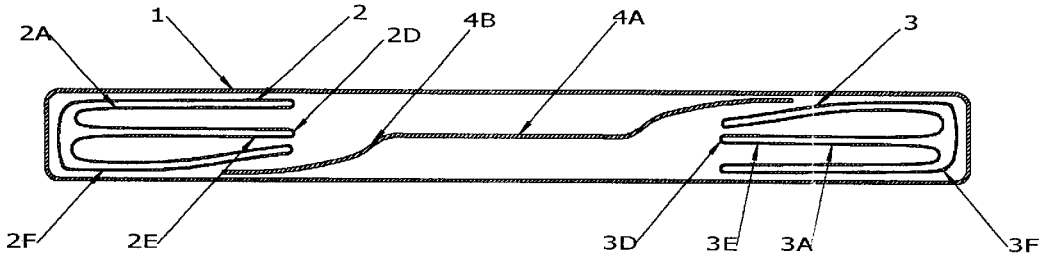

FIG. 2B*iii* show an embodiment wherein both bladders are partially inflated so that each occupies about ½ the projected area of the inflated shell It will be evident that in the event one of the bladders it punctured for example by a sharp instrument there is a very good chance that only one of the bladders (either 2 and 3 in the FIG. 2B*iii* embodiment or the inflated bladder 2 in FIG. 2B*ii* or inflated bladder 3 in the FIG. 2B*i* embodiment) will be damaged. It is then merely necessary to inflate (by mouth as illustrated at 5 or to actuate the inflator 6) to fully inflate the non-punctured bladder 2 or 3. FIG. 3 shows a bladder such as bladders 2 or 3 folded inside itself twice as indicatred by the folds 2E and 3E to further reduce the projected area of such a deflated bladder which inherently further reduces the odds of the so folded deflated bladder being punctured. The divider 4 has been replaced by a wider divider 4A in the FIG. 3 embodiment, however the divider 4A is sized and positioned relative to the bladders 2 and 3 in the same manner as described above for the divider 4. Because of the wider width of the bladder 4A (relative to divider 4) divider 4A will normally be slightly bent as indicated at 4B to fit on opposite sides of the bladders 2 and 3

In the illustrated embodiments more than 2 bladders each inflatable to fill the shell 1 could be strategically positioned within the shell 1 so that there is a more remote chance of all the bladders being punctured at the same time, any one of which could be inflated to fill the shell and maintain its serviceability.

Having described the invention modifications will be evident to those skilled in the art without departing from the spirit of the invention as defined in the appended claims.

We claim:

1. An inflatable device comprising a shape defining shell containing at least two separate inflatable bladders, each said bladder having an inflation means for inflating its respective bladder, each said bladder being of a size when fully inflated to fully inflate said shell into its defining shape, at least one of said bladders being an initially deflated bladder which in deflated condition is folded upon itself to provide a folded end on said deflated bladder, said folded end positioned facing the other of said at least two bladders and said deflated bladder being positioned within said shell so that it occupies no more than 50% of the total cross sectional area of the major surface of said shell when said shell is fully inflated by one of said bladders.

2. An inflatable device as defined in claim 1 wherein said deflated bladder is positioned so that it occupies less than 30% of said cross sectional area.

3. An inflatable device as defined in claim 2 wherein said folded on itself comprise a portion of said at least one bladder being tucked inside other portion of said deflated bladder.

4. An inflatable device as defined in claim 3, wherein a divider panel is interposed between the bladders.

5. An inflatable device as defined in claim 4 wherein each of said at least two bladders are deflated bladders and each is folded upon itself to provide a folded end on each said deflated bladder, said folded ends on each of said deflated bladders positioned adjacent to each other, said divider panel being symmetrically positioned with respect to said adjacent folded ends of said bladders and overlapping each of said bladders in the directions parallel to said folded ends and perpendicular to said folded ends so that during inflation of one of said bladder, said one of said bladders being inflated may slide past the adjacent fold edge an adjacent of said bladders.

6. An inflatable device as defined in claim 5 wherein said inflating means comprises a sealable manual inflating tube.

7. An inflatable device as defined in claim 5 wherein said inflating means comprises manually actuated inflation device.

8. An inflatable device as defined in claim 2 wherein a divider panel is interposed between the bladders.

9. An inflatable device as defined in claim 8 wherein each of said at least two bladders are deflated bladders and each is folded upon itself to provide a folded end on each said deflated bladder, said folded ends on each of said deflated bladders positioned adjacent to each other, said divider panel being symmetrically positioned with respect to said adjacent folded ends of said bladders and overlapping each of said bladders in the directions parallel to said folded ends and perpendicular to said folded ends so that during inflation of one of said bladder, said one of said bladders being inflated may slide past the adjacent fold edge an adjacent of said bladders.

10. An inflatable device as defined in claim 9 wherein said inflating means comprises a sealable manual inflating tube.

11. An inflatable device as defined in claim 9 wherein said inflating means comprises manually actuated inflation device.

12. An inflatable device as defined in claim 1 wherein said folded on itself comprise a portion of said at least one bladder being tucked inside other portion of said deflated bladder.

13. An inflatable device as defined in claim 12 wherein a divider panel is interposed between the bladders.

14. An inflatable device as defined in claim 13 wherein each of said at least two bladders are deflated bladders and each is folded upon itself to provide a folded end on each said deflated bladder, said folded ends on each of said deflated bladders positioned adjacent to each other, said divider panel being symmetrically positioned with respect to said adjacent folded ends of said bladders and overlapping each of said bladders in the directions parallel to said folded ends and perpendicular to said folded ends so that during inflation of one of said bladder, said one of said bladders being inflated may slide past the adjacent fold edge an adjacent of said bladders.

15. An inflatable device as defined in claim 14 wherein said inflating means comprises a sealable manual inflating tube.

16. An inflatable device as defined in claim 14 wherein said inflating means comprises manually actuated inflation device.

17. An inflatable device as defined in claim 1 wherein a divider panel is interposed between the bladders.

18. An inflatable device as defined in claim 17 wherein each of said at least two bladders are deflated bladders and each is folded upon itself to provide a folded end on each said deflated bladder, said folded ends on each of said deflated bladders positioned adjacent to each other, said divider panel being symmetrically positioned with respect to said adjacent folded ends of said bladders and overlapping each of said bladders in the directions parallel to said folded ends and perpendicular to said folded ends so that during inflation of one of said bladder, said one of said bladders being inflated may slide past the adjacent fold edge an adjacent of said bladders.

19. An inflatable device as defined in claim 18 wherein said inflating means comprises a sealable manual inflating tube.

20. An inflatable device as defined in claim 18 wherein said inflating means comprises manually actuated inflation device.

* * * * *